US010746058B2

(12) United States Patent
Ono et al.

(10) Patent No.: US 10,746,058 B2
(45) Date of Patent: Aug. 18, 2020

(54) STEAM TURBINE

(71) Applicants: KABUSHIKI KAISHA TOSHIBA, Minato-ku (JP); TOSHIBA ENERGY SYSTEMS & SOLUTIONS CORPORATION, Kawasaki-shi (JP)

(72) Inventors: Takahiro Ono, Ota (JP); Tsuguhisa Tashima, Yokohama (JP); Shogo Iwai, Ota (JP); Daichi Fukabori, Yokohama (JP)

(73) Assignees: KABUSHIKI KAISHA TOSHIBA, Minato-ku (JP); TOSHIBA ENERGY SYSTEMS & SOLUTIONS CORPORATION, Kawasaki-shi (JP)

( * ) Notice: Subject to any disclaimer, the term of this patent is extended or adjusted under 35 U.S.C. 154(b) by 0 days.

(21) Appl. No.: 16/291,385

(22) Filed: Mar. 4, 2019

(65) Prior Publication Data

US 2019/0277162 A1 Sep. 12, 2019

(30) Foreign Application Priority Data

Mar. 6, 2018 (JP) ..... 2018-039267

(51) Int. Cl.
*F01D 25/28* (2006.01)
*F01D 25/24* (2006.01)
(Continued)

(52) U.S. Cl.
CPC ..... *F01D 25/28* (2013.01); *F01D 25/162* (2013.01); *F01D 25/24* (2013.01); *F01D 25/26* (2013.01);
(Continued)

(58) Field of Classification Search
CPC ..... F01D 25/28; F01D 25/26; F01D 25/24; F01D 25/162; F01D 25/16; F05D 2240/91; F05D 2220/31
(Continued)

(56) References Cited

U.S. PATENT DOCUMENTS 3,773,431 A * 11/1973 Bellati ..... F01D 25/26 415/108
3,881,843 A * 5/1975 Meylan ..... F01D 25/28 415/213.1
(Continued)

FOREIGN PATENT DOCUMENTS

JP 3863596 B2 12/2006
JP 5450237 B2 3/2014

*Primary Examiner* — Hoang M Nguyen
(74) *Attorney, Agent, or Firm* — Oblon, McClelland, Maier & Neustadt, L.L.P.

(57) ABSTRACT

A steam turbine 1 of one embodiment has a side exhaust structure where a condenser 190 is installed at one side in directions perpendicular and horizontal to an axial direction of a turbine rotor 40 and supported on a foundation 70. The steam turbine 1 includes an outer casing 10 having an outer casing upper half 12 and an outer casing lower half 13; a groove part 100 formed in each of a pair of lower half end plates 17 extending perpendicular to the axial direction of the turbine rotor 40, the groove part 100 being opened upward and being recessed to an inside of the outer casing 10; and a block-shaped key member 120 fitted to both the groove parts 100 and 110, a groove part 110 being formed at a part of the foundation 70 facing the groove part 100, the groove part 110 being opened upward.

6 Claims, 10 Drawing Sheets

(51) Int. Cl.
*F01D 25/16* (2006.01)
*F01D 25/26* (2006.01)

(52) U.S. Cl.
CPC ..... *F05D 2220/31* (2013.01); *F05D 2240/91* (2013.01)

(58) Field of Classification Search
USPC ..... 415/126, 213.1, 214.1; 60/685, 690
See application file for complete search history.

(56) References Cited

U.S. PATENT DOCUMENTS

| | | | | |
|---|---|---|---|---|
| 5,779,435 | A * | 7/1998 | Lageder | F01D 25/24<br>184/106 |
| 10,487,692 | B2 * | 11/2019 | Ono | F01D 25/30 |
| 2011/0014031 | A1 * | 1/2011 | Kawashita | F01D 25/26<br>415/119 |
| 2014/0250859 | A1 * | 9/2014 | Onoda | F01D 25/12<br>60/39.12 |
| 2018/0202320 | A1 * | 7/2018 | Mitsui | F01D 25/30 |

* cited by examiner

STEAM TURBINE

CROSSREFERENCE TO RELATED APPLICATIONS

This application is based upon and claims the benefit of priority from Japanese Patent Application No. 2018-039267, filed on Mar. 6, 2018; the entire contents of which are incorporated herein by reference.

FIELD

Embodiments described herein relate generally to a steam turbine.

BACKGROUND

A steam turbine is mainly composed of a high-pressure turbine to which main steam is guided, an intermediate-pressure turbine to which reheated steam is guided, and a low-pressure turbine to which steam exhausted from the intermediate turbine is guided.

For example, in the low-pressure turbine, an outer casing which is a pressure vessel is divided into two parts of an outer casing upper half and an outer casing lower half at a horizontal plane including the rotary shaft center line of a turbine rotor. A flange part of the outer casing upper half and a flange part of the outer casing lower half are fastened to each other by bolts or like.

A foot plate is provided to a side surface close to the flange part of the outer casing lower half. This foot plate is fixed to a foundation. The outer casing is supported on the foundation by the foot plate.

The low-pressure turbine is coupled to a condenser. Steam exhausted from the low-pressure turbine is condensed in the condenser so as to generate condensate.

Examples of an exhaust structure in the low-pressure turbine include a downward exhaust structure in which the condenser is disposed on the vertically lower side, an axial-flow exhaust structure in which the condenser is disposed on the axially downstream side, a side exhaust structure in which the condenser is disposed perpendicular and horizontal to the axial direction of the turbine rotor, and the like.

Among the above exhaust structures, the downward exhaust structure is more common as the exhaust structure used in the low-pressure turbine. The axial direction of the turbine rotor refers to a direction in which the shaft center line of the turbine rotor extends.

A connection method of connecting the low-pressure turbine and condenser is roughly classified into two. The first one is a method of flexibly connecting the low-pressure turbine and the condenser through an expandable member called "expansion". The expansion is formed of, e.g., rubber, stainless, or the like.

The second one is a method of rigidly connecting the low-pressure turbine and the condenser by welding or bolt fastening. In this case, the low-pressure turbine and the condenser constitute one pressure vessel, so that they exert force according to an operation state to each other.

When the second method, i.e., the rigid connection method is adopted, the temperature in the low-pressure turbine and in the condenser rises at, e.g., the start-up of the turbine, to thermally expand the low-pressure turbine and condenser. At this time, reaction force to prevent the thermal expansion acts on a support part for the low-pressure turbine and condenser.

The inside of the outer casing of the low-pressure turbine is caused to be in a vacuum state by the condenser. Accordingly, the outer casing receives a load due to a difference between pressure applied to the outer surface thereof and pressure applied to the inner surface thereof. Typically, this load is called "vacuum load".

In the downward exhaust structure, the vacuum load and reaction force due to thermal expansion and contraction vertically acts on the outer casing of the low-pressure turbine. The outer casing in the downward exhaust structure has, on the foundation, the foot plate having a large installation area and can thus receive the above load.

On the other hand, in a low-pressure turbine in the side exhaust structure provided with the condenser on one side of the outer casing, the load acts on the side at which the condenser of the outer casing is provided in directions perpendicular and horizontal to the axial direction of the turbine rotor.

FIG. 9 is a vertical cross-section view of a conventional low-pressure turbine 200 having the downward exhaust structure. FIG. 10 is a view illustrating an X-X cross section in FIG. 9.

As illustrated in FIG. 9, the low-pressure turbine 200 includes an outer casing 210, an inner casing 220 provided inside the outer casing 210, and a turbine rotor 230 penetrating the outer casing 210 and inner casing 220. In the inner casing 220, stationary blades 223 each supported between a diaphragm outer ring 221 and a diaphragm inner ring 222 and rotor blades 231 implanted to the turbine rotor 230 are alternately provided in the rotor axial direction.

A suction chamber 241 into which steam from a crossover pipe 240 is introduced is provided at the center of the low-pressure turbine 200. The introduced steam is distributed from the suction chamber 241 to left and right turbine stages.

On the downstream side of the final turbine stage, an annular diffuser 247 is formed by an outer peripheral side steam guide 245 and a cone 246 positioned on the inner peripheral side of the steam guide 245. The annular diffuser 247 exhausts steam radially outward.

As described above, the outer casing 210 is composed of an outer casing upper half 210*a* and an outer casing lower half 210*b*. As illustrated in FIG. 9, a pair of end plates 211 provided in the outer casing lower half 210*b* so as to extend perpendicular to the axial direction of the turbine rotor 230 each have a foot plate 212.

For example, the foot plate 212 extends perpendicular and horizontal to the axial direction of the turbine rotor 230. As illustrated in FIG. 9, the foot plate 212 is placed on a foundation 250 through, e.g., a sole plate 213. In this manner, the outer casing lower half 210*b*, i.e., outer casing 210 is supported on the foundation 250.

Although not illustrated, a pair of side plates provided in the outer casing lower half 210*b* so as to extend parallel to the axial direction of the turbine rotor 230 each also have a foot plate. This foot plate is also placed on the foundation 250.

Further, a bearing stand 260 is fixed onto the foundation 250 through, e.g., the sole plate 213. A bearing 261 supported on the bearing stand 260 is provided in a bearing casing 262. The turbine rotor 230 is rotatably supported by the bearing 261.

As illustrated in FIGS. 9 and 10, a center key 214 is provided on the foot plate 212 extending from the end plate 211. The center key 214 is disposed at the center of the width (width of the end plate 211 in directions perpendicular and horizontal to the axial direction of the turbine rotor 230) of the end plate 211. The center key 214 protrudes from the foot plate 212 to the bearing stand 260 side.

As illustrated in FIG. 10, a key fitting member 263 having a fitting groove 263*a* fitted to the center key 214 is fixed onto the end surface of the bearing stand 260 that is opposed to the center key 214. The center key 214 is integrally or detachably fixed to the foot plate 212.

Fitting the center key 214 to the fitting groove 263*a* of the key fitting member 263 allows alignment between the outer casing 210 and the turbine rotor 230 to be secured.

As described above, the fitting structure between the center key 214 and the key fitting member 263 is provided for securing the alignment. Therefore, as illustrated in FIG. 10, the center key 214 is formed of a member smaller in width (width in directions perpendicular and horizontal to the axial direction of the turbine rotor 230) and size. Further, such a fitting structure is positioned above the upper surface of the foundation 250.

As described above, in the low-pressure turbine having the side exhaust structure provided with the condenser on one side of the outer casing, the load acts on the outer casing in a direction perpendicular to the axial direction of the turbine rotor and in a direction horizontal to the side at which the condenser is provided.

Further, as described above, the fitting structure between the center key 214 and the key fitting member 263 in the conventional low-pressure turbine 200 having the downward exhaust structure is provided for securing the alignment.

Thus, when the above fitting structure is applied to the low-pressure turbine having the side exhaust structure, it is difficult for the fitting structure to bear the above load. When the fitting structure cannot bear the load, it may be broken to fail to maintain the outer casing at a predetermined proper position. This reduces reliability of turbine performance or turbine operation.

DETAILED DESCRIPTION

Hereinafter, embodiments of the present invention will be described with reference to the drawings.

In one embodiment, a steam turbine has a side exhaust structure where a condenser is installed at one side in directions perpendicular and horizontal to an axial direction of a turbine rotor and supported on a foundation. The steam turbine includes an outer casing penetrated with the turbine rotor and vertically divided into an outer casing upper half and an outer casing lower half; a first groove part formed, inside the outer casing lower half, in each of a pair of end plates extending perpendicular to the axial direction of the turbine rotor, the first groove part being opened upward, the first groove part being recessed to an inside of the outer casing; and a block-shaped key member fitted to both the first groove part and a second groove part, the second groove part being formed at a part of the foundation facing the first groove part, the second groove part being opened upward.

First Embodiment

Figure 1:
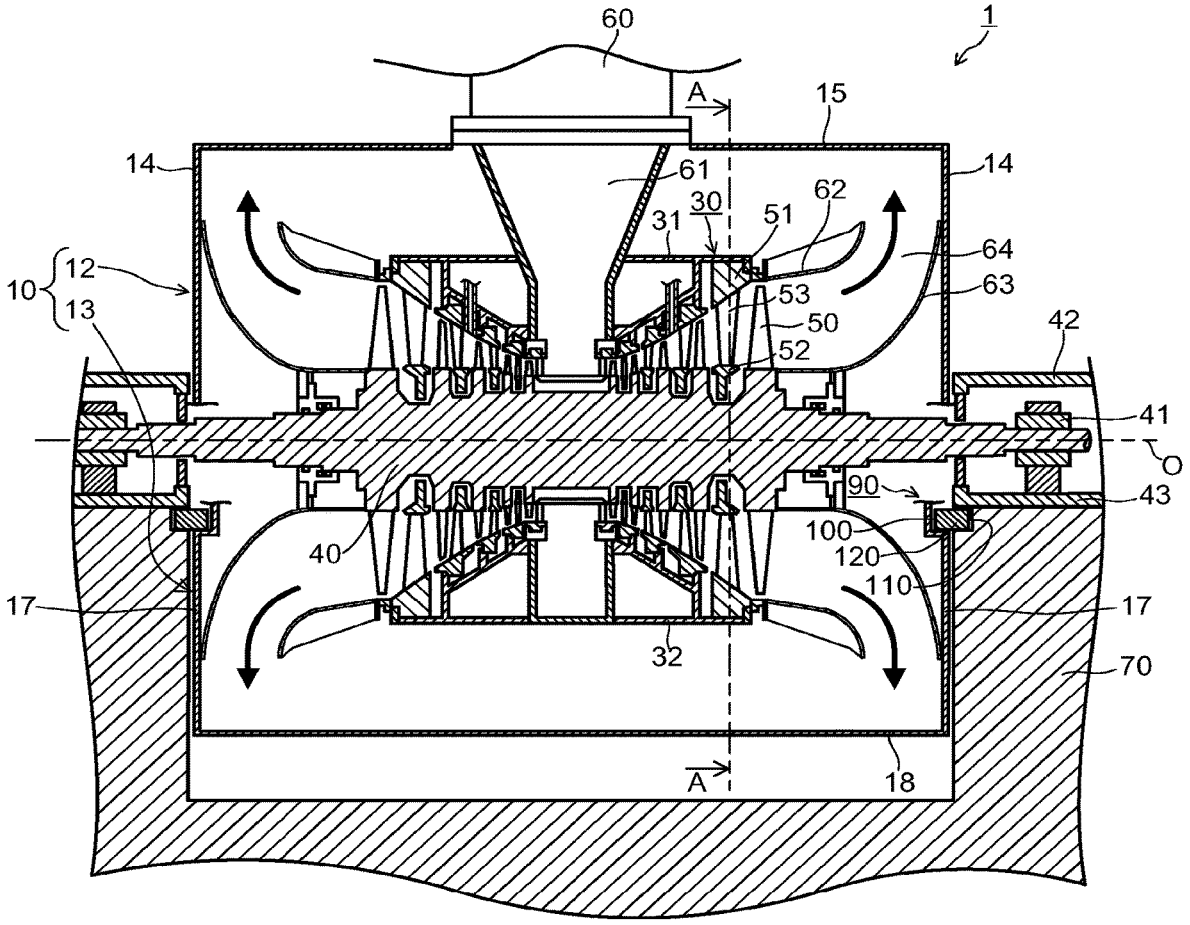
FIG. 1 is a vertical cross-section view of a steam turbine according to a first embodiment.
Figure 2:
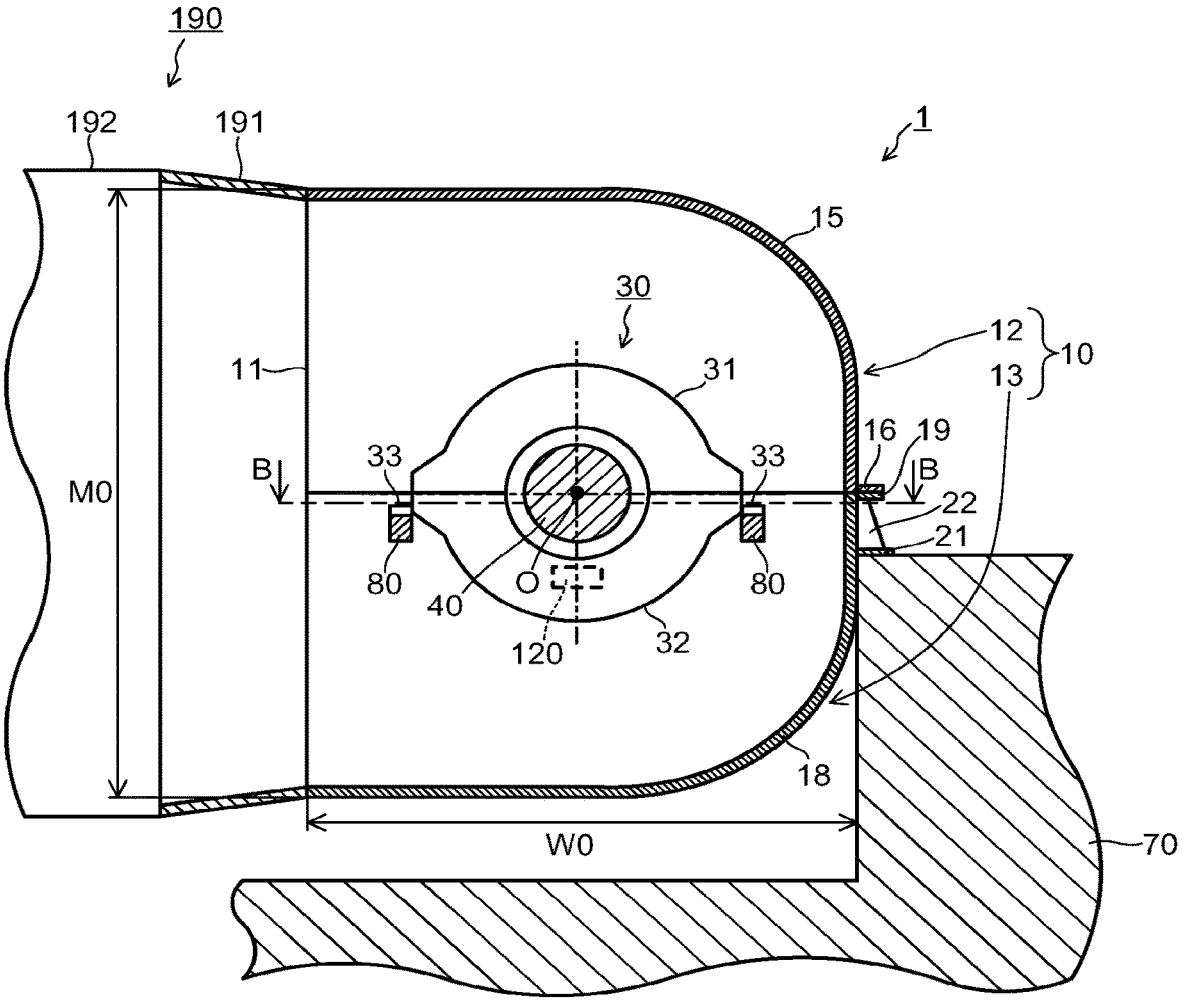
FIG. 2 is a view illustrating an A-A cross section in FIG. 1.
Figure 3:
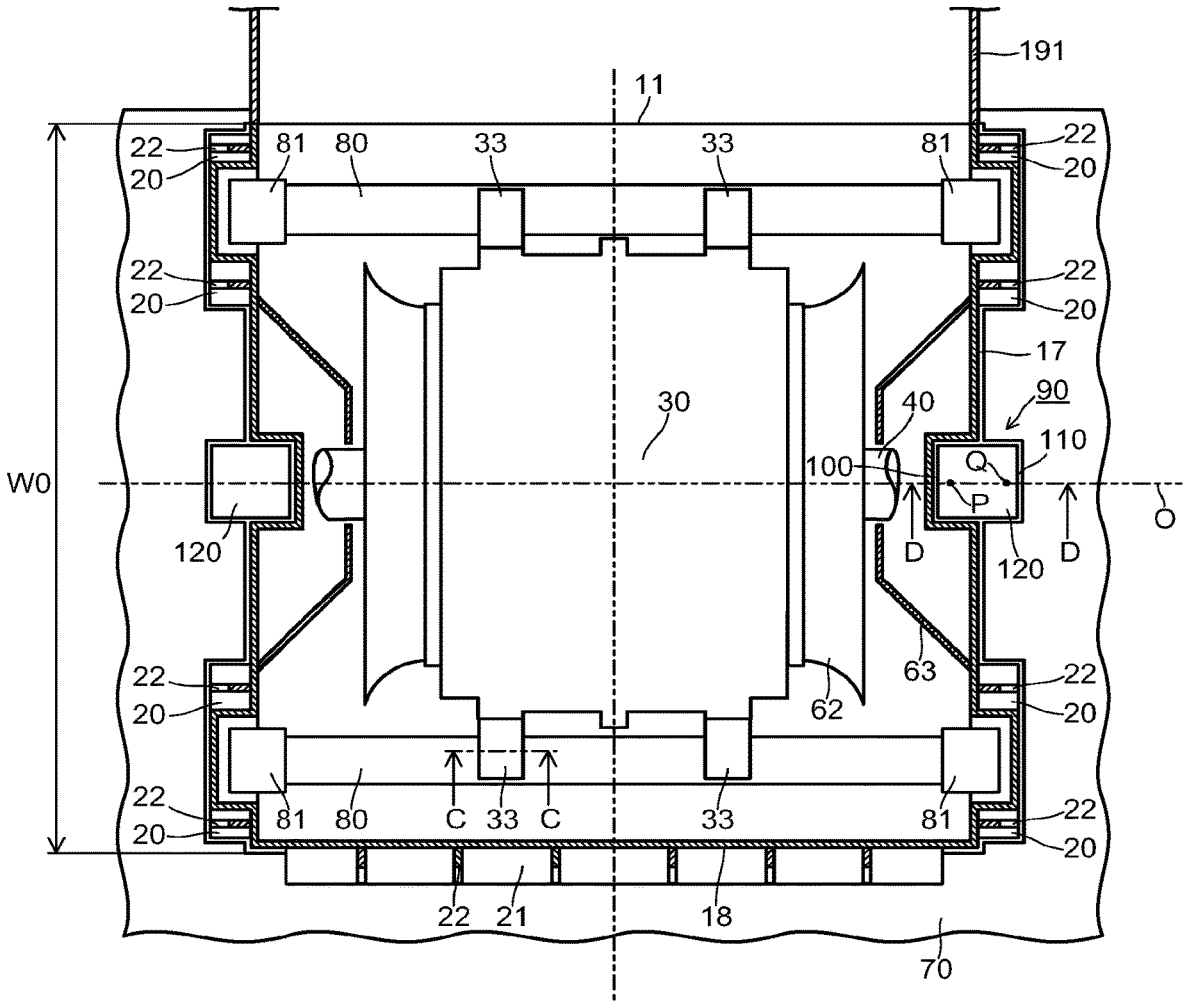
FIG. 3 is a view illustrating a B-B cross section in FIG. 2.

FIG. 1 is a vertical cross-section view of a steam turbine 1 according to a first embodiment. FIG. 2 is a view illustrating an A-A cross section in FIG. 1. FIG. 3 is a view illustrating a B-B cross section in FIG. 2.

In FIGS. 2 and 3, the configuration of the steam turbine 1 is partially omitted. In FIG. 3, the outer appearance of an inner casing 30 is illustrated in a plan view. Further, in FIG. 3, a part of a turbine rotor 40 and a bearing part (bearing 41, bearing casing 42, bearing stand 43) are omitted in order to make the configuration of a key member 120 to be described later clear.

As illustrated in FIG. 1, the steam turbine 1 includes an outer casing 10, an inner casing 30 provided inside the outer casing 10, and a turbine rotor 40 penetrating the outer casing 10 and inner casing 30. The steam turbine 1 according to the first embodiment is a low-pressure turbine.

In the inner casing 30, rotor blades 50 are implanted to the turbine rotor 40 in a circumferential direction. A rotor blade cascade is made up by implanting a plurality of the rotor blades 50 in the circumferential direction. A plurality of stages of the rotor blade cascades are arranged in the axial direction of the turbine rotor 40.

Stationary blades 53 are each supported between a diaphragm outer ring 51 and a diaphragm inner ring 52 in the inner circumference of the inner casing 30 such that the stationary blades 53 and the rotor blades 50 are alternately arranged in the axial direction of the turbine rotor 40. A stationary blade cascade is made up by providing a plurality of the stationary blades 53 in the circumferential direction. One turbine stage is made up by the stationary blade cascade and the rotor blade cascade positioned immediately downstream of the stationary blade cascade.

The turbine rotor 40 is rotatably supported by a bearing 41. The bearing 41 is disposed inside a bearing casing 42 and supported by a bearing stand 43. The bearing stand 43 is disposed on a foundation 70.

The turbine rotor 40 is coupled with a generator (not illustrated). The bearing stand 43 may be disposed on the foundation 70 through a sole plate, etc.

A suction chamber 61 into which steam from a crossover pipe 60 is introduced is provided at the center of the steam turbine 1. The introduced steam is distributed from the suction chamber 61 to left and right turbine stages.

On the downstream side of the final turbine stage, an annular diffuser 64 is formed by an outer peripheral side steam guide 62 and a cone 63 positioned on the inner circumferential side of the steam guide 62. The annular diffuser 64 exhausts steam radially outward.

As illustrated in FIG. 2, the outer casing 10 of the steam turbine 1 has a side exhaust port 11 at one side end portion thereof in directions perpendicular and horizontal to the axial direction of the turbine rotor 40. The side exhaust port 11 is connected to a condenser 190.

For example, the condenser 190 includes an introduction duct 191 connected to the side exhaust port 11 and a condenser body 192 to which stream passing through the introduction duct 191 is guided. As described above, the steam turbine 1 has a side exhaust structure.

Steam introduced through the crossover pipe 60 and passing through the turbine stages passes through the annular diffuser 64 and flows inside the outer casing 10 toward the side exhaust port 11. The steam exhausted from the side exhaust port 11 into the introduction duct 191 is guided into the condenser body 192. The steam guided into the condenser body 192 is condensed so as to generate condensate.

The turbine rotor 40 is driven into rotation by the steam passing through the turbine stages, causing the generator coupled to the turbine rotor 40 to generate power.

The following describes a support structure for the outer casing 10 and inner casing 30.

As illustrated in FIG. 2, the cross-sectional shape of the outer casing 10 in a direction perpendicular to the axial direction of the turbine rotor 40 is formed in a shape obtained by rotating a U-shape by 90 degrees. The U-shaped outer casing 10 illustrated in FIG. 2 has a substantially semielliptical shaped wall portion and flat plate-like wall portions horizontally extending from the end portions of the substantially semielliptical shaped wall portion.

The outer casing 10 is divided into two parts of an outer casing upper half 12 and an outer casing lower half 13 at a horizontal plane including a shaft center line O of the turbine rotor 40. Like the outer casing 10, the inner casing 30 is also divided into two parts of an inner casing upper half 31 and an inner casing lower half 32 at the horizontal plane including the shaft center line O of the turbine rotor 40.

In this example, the division horizontal plane between the outer casing upper half 12 and the outer casing lower half 13 is the horizontal plane including the shaft center line O of the turbine rotor 40, but the constitution is not limited thereto. For example, the division horizontal plane between the outer casing upper half 12 and the outer casing lower half 13 may be positioned above or below the horizontal plane including the shaft center line O of the turbine rotor 40.

As illustrated in FIGS. 1 and 2, the outer casing upper half 12 includes a pair of upper half end plates 14 extending perpendicular to the axial direction of the turbine rotor 40, an upper half side plate 15 provided between the pair of upper half end plates 14, and an upper half flange part 16.

The cross-sectional shape of the upper half side plate 15 in a direction perpendicular to the axial direction of the turbine rotor 40 is formed in a shape corresponding to the upper half portion of the 90-degree rotated U-shape obtained by cutting the U-shape at the horizontal plane (division horizontal plane between the outer casing upper half 12 and the outer casing lower half 13) including the shaft center line O of the turbine rotor 40 (see FIG. 2). The upper half side plate 15 has a shape obtained by extending the shape corresponding to the upper half portion in the axial direction of the turbine rotor 40.

Both ends of the upper half side plate 15 in the axial direction of the turbine rotor 40 are closed by the upper half end plates 14, respectively.

The upper half flange part 16 is provided along the lower end portions of the upper half end plates 14 and the lower end portion of the upper half side plate 15.

The outer casing lower half 13 includes a pair of lower half end plates 17 extending perpendicular to the axial direction of the turbine rotor 40, a lower half side plate 18 provided between the pair of lower half end plates 17, and a lower half flange part 19.

The cross-sectional shape of the lower half side plate 18 in a direction perpendicular to the axial direction of the turbine rotor 40 is formed in a shape corresponding to the lower half portion of the 90-degree rotated U-shape obtained by cutting the U-shape at the horizontal plane (division horizontal plane between the outer casing upper half 12 and the outer casing lower half 13) including the shaft center line O of the turbine rotor 40 (see FIG. 2). The lower half side plate 18 has a shape obtained by extending the shape corresponding to the lower half portion in the axial direction of the turbine rotor 40.

Both ends of the lower half side plate 18 in the axial direction of the turbine rotor 40 are closed by the lower half end plates 17, respectively.

The lower half flange part 19 is provided along the upper end portions of the lower half end plates 17 and the upper end portion of the lower half side plate 18.

The upper half flange part 16 of the outer casing upper half 12 and the lower half flange part 19 of the outer casing lower half 13 are fastened to each other by bolts or the like. The outer casing 10 is constituted by thus integrating the outer casing upper half 12 and the outer casing lower half 13.

As illustrated in FIG. 3, the outer casing lower half 13 has a first foot plate 20 provided to each of the lower half end plates 17. For example, the first foot plate 20 is fixed to the outer surface of the lower half end plate 17 below the lower half flange part 19.

For example, the outer casing lower half 13 has four first foot plates 20 on both sides of the lower half end plate 17 in the width direction thereof perpendicular to the axial direction of the turbine rotor 40. The first foot plate 20 is, e.g., a flat plate-like member and protrudes outward of the outer casing lower half 13 from the lower half end plate 17. The protruding direction of the first foot plate 20 coincides with, e.g., the axial direction of the turbine rotor 40.

Further, as illustrated in FIGS. 2 and 3, the outer casing lower half 13 has a second foot plate 21 provided to the lower half side plate 18. For example, the second foot plate 21 is fixed to the outer surface of the lower half side plate 18 below the lower half flange part 19.

As illustrated in FIG. 3, the second foot plate 21 extends along the outer side surface of the lower half side plate 18 in the axial direction of the turbine rotor 40. The second foot plate 21 protrudes outward from the lower half side plate 18. The second foot plate 21 protrudes perpendicular and horizontal to the axial direction of the turbine rotor 40.

The first foot plates 20 are placed on the upper surface of the foundation 70 at positions in the vicinity of the lower half end plates 17, and the second foot plate 21 is placed on the upper surface of the foundation 70 at a position in the vicinity of the lower half side plate 18, whereby the outer casing lower half 13 is supported on the foundation 70. That is, the outer casing 10 is supported on the foundation 70.

The first foot plates 20 and the second foot plate 21 may be directly placed on the upper surface of the foundation 70 or may be placed thereon through, e.g., a sole plate (not illustrated).

As illustrated in FIGS. 2 and 3, in order to enhance structural strength, reinforcing ribs 22 may be provided, e.g., between the first foot plate 20 and the lower half flange part 19 and between the second foot plate 21 and the lower half flange part 19.

Further, as illustrated in FIGS. 2 and 3, a pair of support beams 80 for supporting the inner casing 30 are provided inside the outer casing 10. As illustrated in FIG. 2, the support beams 80 each extend in the axial direction of the turbine rotor 40 at a position where the upper surface thereof is below the shaft center line O of the turbine rotor 40. The support beams 80 each horizontally extend in parallel to the shaft center line O of the turbine rotor 40.

As illustrated in FIG. 3, as viewed from above, the support beams 80 are disposed in the vicinity of the inner casing 30 so as to sandwich the inner casing 30 therebetween. Specifically, as viewed from above, the support beams 80 are disposed between the inner casing 30 and the lower half side plate 18 and between the inner casing 30 and the side exhaust port 11.

The support beams 80 each have beam end parts 81 provided, respectively, at both ends in the axial direction of the turbine rotor 40. For example, the beam end parts 81 are each placed on the first foot plate 20. Accordingly, the support beams 80 are each positioned at a height based on the upper surface of the foundation 70.

As illustrated in FIGS. 2 and 3, the inner casing lower half 32 has four arms 33 provided perpendicular and horizontal to the axial direction of the turbine rotor 40. The arms 33 are each, e.g., a flat plate-like member and protrude from the upper end portion of the inner casing lower half 32 toward the outside thereof. As illustrated in FIG. 3, two arms 33 are provided at each of both sides of the shaft center line O of the turbine rotor 40 as viewed from above.

Figure 4:
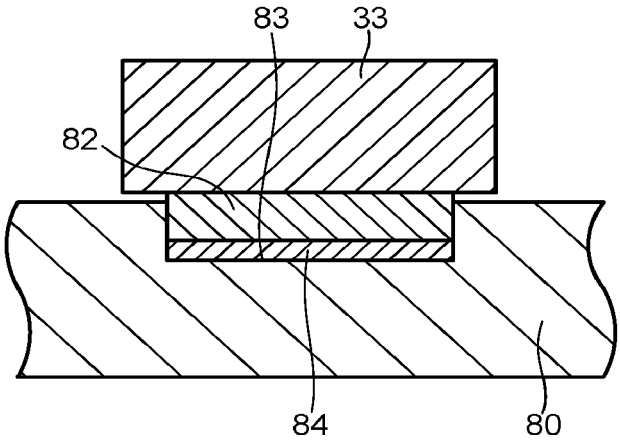
FIG. 4 is a view illustrating a C-C cross section in FIG. 3.

FIG. 4 is a view illustrating a C-C cross section in FIG. 3.

As illustrated in FIG. 4, the support beam 80 has a beam groove 83 opened upward. The beam groove 83 is where a seat 82 is inserted. The arm 33 is placed on the seat 82. The upper surface of the seat 82 is positioned above the upper surface of the support beam 80 so that the arm 33 does not come into contact with the support beam 80. This allows the arm 33 to slide with respect to the seat 82.

For example, a shim 84 for adjusting the height position of the inner casing 30 may be interposed between the seat 82 and the bottom surface of the beam groove 83. The support structure for the inner casing 30 is not limited to the above structure.

The following describes a fixing structure for the outer casing 10.

Figure 5:
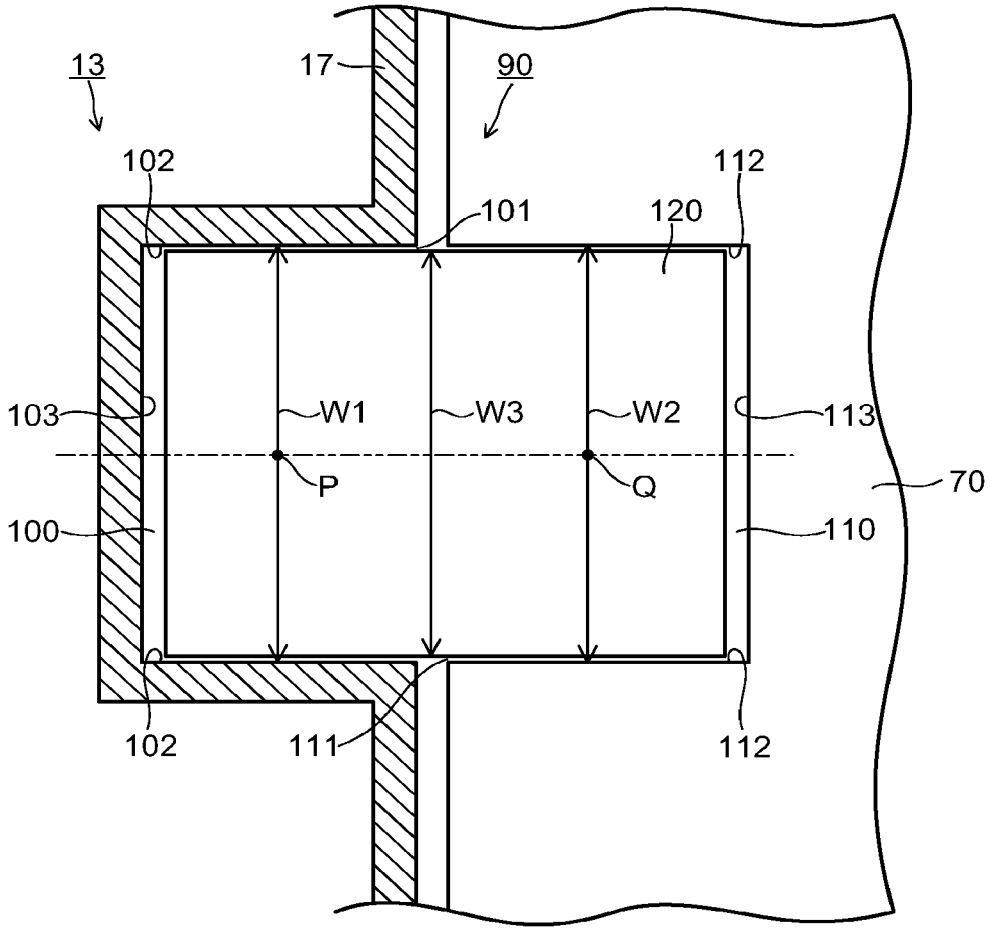
FIG. 5 is an enlarged view illustrating a fixing structure part for the outer casing illustrated in FIG. 3.
Figure 6:
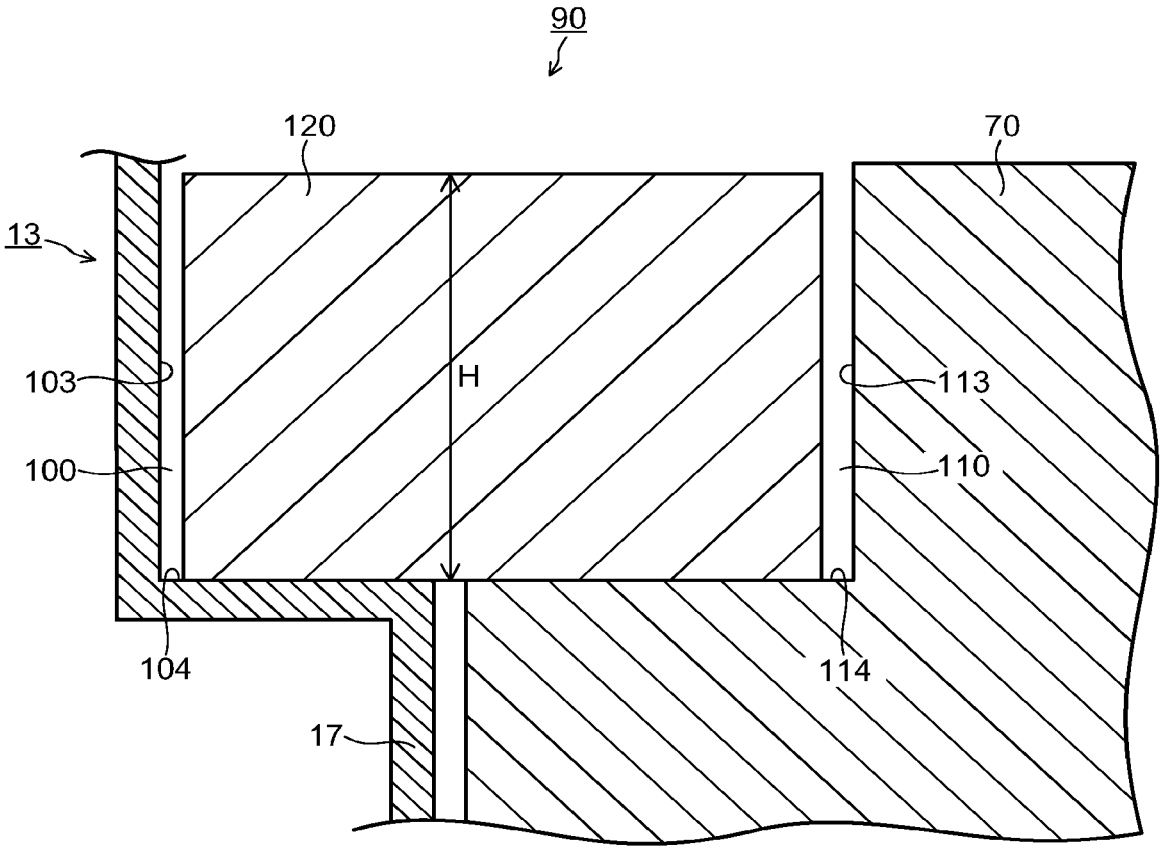
FIG. 6 is a view illustrating a D-D cross section in FIG. 3.

FIG. 5 is an enlarged view illustrating a fixing structure part 90 for the outer casing 10 illustrated in FIG. 3. FIG. 6 is a view illustrating a D-D cross section in FIG. 3.

The fixing structure part 90 for fixing the outer casing 10 to the foundation 70 is provided to the outer casing 10 and the foundation 70. As illustrated in FIG. 1 and FIGS. 3 to 5, the fixing structure part 90 includes a groove part 100 formed in the lower half end plate 17 of the outer casing lower half 13, a groove part 110 formed in the foundation 70, and a key member 120 fitted to the groove part 100 and the groove part 110.

The groove part 100 functions as a first groove part, and the groove part 110 functions as a second groove part.

As viewed from above, the groove part 100 is recessed to the inner side of the outer casing lower half 13 in a U-shape in cross section as illustrated in FIGS. 3 and 5. The groove part 100 includes a pair of side surfaces 102, 102 extending in parallel to the axial direction of the turbine rotor 40 from a U-shaped opening 101 and an end surface 103 facing the opening 101 and extending perpendicular to the axial direction of the turbine rotor 40. Further, in the vertical cross-section views of FIGS. 1 and 6, the groove part 100 is bent in an L-shape and has thus a bottom surface 104 constituting a horizontal stage.

As described above, the groove part 100 is composed of four surfaces: the side surfaces 102, 102, end surface 103, and bottom surface 104. The groove part 100 is opened upward so as to allow the key member 120 to be inserted thereinto from above.

The groove part 110 is formed at a part of the foundation 70 that faces the groove part 100. For example, the groove part 110 is formed by cutting the foundation 70.

As viewed from above, the groove part 110 is recessed to the inner side of the foundation 70 in a U-shape in cross section as illustrated in FIGS. 3 and 5. The groove part 110 includes a pair of side surfaces 112, 112 extending in parallel to the axial direction of the turbine rotor 40 from a U-shaped opening 111 and an end surface 113 facing the opening 111 and extending perpendicular to the axial direction of the turbine rotor 40. Further, in the vertical cross-section views of FIGS. 1 and 6, the groove part 110 is bent in an L-shape and thus has a bottom surface 114 constituting a horizontal stage.

As described above, the groove part 110 is composed of four surfaces: the side surfaces 112, 112, the end surface 113, and the bottom surface 114. The groove part 110 is opened upward so as to allow the key member 120 to be inserted thereinto from above.

The groove part 100 and the groove part 110 have substantially the same dimension.

As illustrated in FIG. 5, a center P of a width W1 of the groove part 100 in directions perpendicular and horizontal to the axial direction of the turbine rotor 40 and a center Q of a width W2 of the groove part 110 in directions perpendicular and horizontal to the axial direction of the turbine rotor 40 are positioned vertically below the shaft center line O of the turbine rotor 40.

That is, when the center P of the groove width W1 and the center Q of the groove width W2 are viewed in the cross section illustrated in FIG. 3, the center P and the center Q are positioned so as to overlap the shaft center line O of the turbine rotor 40.

Further, in the horizontal cross section including the shaft center line O of the turbine rotor 40, the shaft center line O of the turbine rotor 40 is positioned at the center of a width W0 of the outer casing 10 in a direction perpendicular to the axial direction of the turbine rotor 40 (see FIG. 3).

While, in the above description, the center of the width W0 horizontally coincides with the position of the shaft center line O as illustrated in FIGS. 2 and 3, the constitution is not limited thereto. For example, in FIG. 2, the center of the width W0 may be positioned on the left or right side of the shaft center line O.

The key member 120 is, e.g., a column-shaped block member made of metal or the like. In the present embodiment, the key member 120 has a rectangular parallelepiped shape. The key member 120 may be, e.g., a cube-shaped block member. The key member 120 is fitted to both the groove part 100 and groove part 110.

As described above, a load due to the vacuum load or thermal expansion acts, in directions perpendicular and horizontal to the axial direction of the turbine rotor 40, on one side of the steam turbine 1 having the side exhaust structure at which the condenser 190 of the outer casing 10 is provided.

Thus, a width (width in directions perpendicular and horizontal to the axial direction of the turbine rotor 40) W3 of the key member 120 and a height (thickness in the vertical direction) H of the key member 120 are dimensioned so as to allow the key member 120 to bear the load and reliably fix the outer casing 10.

Then, based on the size of the key member 120, the groove width W1, groove width W2, and heights (vertical heights) of the respective groove parts 100 and 110 are set. The groove width W1 and the groove width W2 are set to be slightly larger than the width W3 of the key member 120 so as to allow the key member 120 to be inserted properly. The groove width W1 and the groove width W2 have substantially the same dimension.

The heights of the respective groove parts 100 and 110 are set such that, when the key member 120 is fitted to the groove parts 100 and 110, the upper surface of the key member 120 is positioned below the upper surface of the foundation 70. In other words, the key member 120 is preferably disposed so that the upper surface of the key member 120 is positioned on the same plane as the upper surface of the foundation 70 or disposed at a position as high as possible within the extent that the upper surface of the key member 120 does not go beyond the upper surface of the foundation 70.

As illustrated in FIG. 1, the bearing stand 43 having the bearing 41 rotatably supporting the turbine rotor 40 is fixed onto the foundation 70. At this time, the groove part 110 is positioned vertically below the bearing stand 43. In other words, a part of the bearing stand 43 is positioned vertically above the groove part 110. Specifically, the upward opening of the groove part 110 is covered with a part of the bearing stand 43. Thus, a part of the key member 120 that is fitted to the groove part 110 is positioned vertically below the bearing stand 43.

As described above, the upper surface of the key member 120 is positioned below the upper surface of the foundation 70. Thus, even when the bearing stand 43 is installed on the foundation 70 so as to cover the groove part 110 from above, the key member 120 and the bearing stand 43 do not contact each other. This prevents the load of the bearing part including the bearing stand 43 from being applied to the key member 120.

Even when the load acts on the outer casing 10 in directions perpendicular and horizontal to the axial direction of the turbine rotor 40, the key member 120 prevents the outer casing 10 from moving to these directions.

When installing the fixing structure part 90 for the outer casing 10, the outer casing lower half 13 is first placed on the foundation 70. At this time, the first and second foot plates 20 and 21 of the outer casing lower half 13 are placed on the upper surface of the foundation 70.

Subsequently, the key member 120 is fitted to the groove part 100 of the outer casing lower half 13 and the groove part 110 of the foundation 70 facing the groove part 100 to constitute the fixing structure part 90. As described above, the key member 120 is fitted to the groove parts 100 and 110 on both sides in the axial direction of the turbine rotor 40 to constitute the fixing structure part 90. Then, after fitting of the key member 120, the bearing part and the like are installed on the foundation 70.

The following describes another configuration of the fixing structure part 90 according to the first embodiment.

Figure 7:
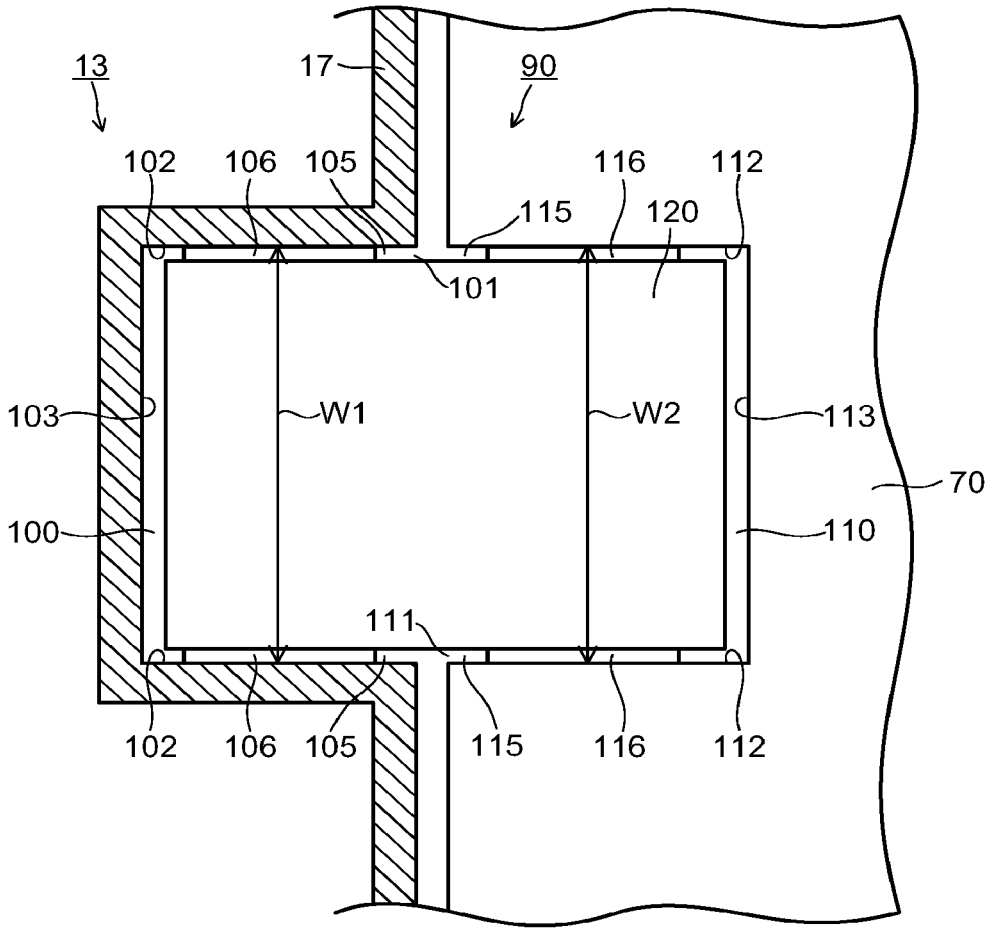
FIG. 7 is an enlarged view illustrating another configuration of the fixing structure part for the outer casing illustrated in FIG. 3.

FIG. 7 is an enlarged view illustrating another configuration of the fixing structure part 90 for the outer casing 10 illustrated in FIG. 3. That is, FIG. 7 is a top view illustrating another configuration of the fixing structure part 90.

As illustrated in FIG. 7, the groove width W1 of the groove part 100 may be set such that a gap 105 is provided between the groove part 100 and the key member 120 in directions perpendicular and horizontal to the axial direction of the turbine rotor 40. For example, as illustrated in FIG. 7, the gap 105 may be provided between each of the pair of opposing side surfaces 102, 102 and the key member 120.

An adjusting spacer 106 is disposed in the gap 105 so as to suppress the movement of the outer casing 10 in the direction of the width W1 in the groove part 100.

Further, the groove width W2 of the groove part 110 may be set such that a gap 115 is provided between the groove part 110 and the the key member 120 in directions perpendicular and horizontal to the axial direction of the turbine rotor 40. For example, as illustrated in FIG. 7, the gap 115 may be provided between each of the pair of opposing side surfaces 112, 112 and the key member 120.

An adjusting spacer 116 is disposed in the gap 115 so as to suppress the movement of the key member 120 in the direction of the width W2 in the groove part 110.

As illustrated in FIG. 7, the gap may be provided in both the groove part 100 and groove part 110. Alternatively, the gap may be provided in one of the groove part 100 and groove part 110.

The adjusting spacers 106 and 116 are also referred to as a shim. The adjusting spacers 106 and 116 are each made of, e.g., a metal thin plate.

For example, a concrete material or the like may be poured into the gap 115 of the groove part 110 in the foundation 70 as the adjusting spacer 116. In this case, the concrete material is poured in the gap 115 after adjustment of the gap 115 between the side surfaces 112 and the key member 120. By using the concrete material as the adjusting spacer 116, the foundation 70 and the key member 120 are rigidly fixed.

By thus providing the gaps 105 and 115 and disposing the adjusting spacers 106 and 116 in the gaps 105 and 115, respectively, it is possible to adjust the position of the outer casing 10 in directions perpendicular and horizontal to the axial direction of the turbine rotor 40, for example.

By thus providing the fixing structure part 90 for the outer casing 10 in the steam turbine 1 according to the first embodiment, it is possible to rigidly fix the outer casing 10 to the foundation 70.

Thus, even when the load acts, in directions perpendicular and horizontal to the axial direction of the turbine rotor 40, on one side of the outer casing 10 at which the condenser 190 is provided, the position of the outer casing 10 with respect to the turbine rotor 40 can be maintained at a proper position. Thus, in the steam turbine 1, reliability of turbine performance and turbine operation can be ensured.

The following describes another operation/effect with reference to FIG. 2. In FIG. 2, the fixing position of the outer casing 10 to the foundation 70, i.e., the position of the key member 120 is denoted by the dashed line.

Assume that the outer casing 10 is viewed in the direction of FIG. 2. In this case, when the load acts, in directions perpendicular and horizontal to the axial direction of the turbine rotor 40, on one side of the outer casing 10 at which the condenser 190 is provided, force acts on the outer casing 10 in the counterclockwise direction centering on the cross-sectional center of the outer casing 10.

The cross-sectional center of the outer casing 10 refers to, e.g., a point where the center of a height M0 in the vertical direction of the outer casing 10 and the center of the width W0 in the horizontal direction of the outer casing 10 overlap each other.

For example, in the cross section illustrated in FIG. 2, the cross-sectional center of the outer casing 10 coincides with the shaft center (shaft center line O) of the turbine rotor 40.

As described above, there may be a case where the position of the center of the width W0 and the shaft center line O are deviated from each other. While, in this example, the position of the center of the height M0 coincides with the shaft center line O, the constitution is not limited thereto. For example, the center of the height M0 may be positioned above or below the position of the shaft center line O.

The outer casing 10 illustrated in FIG. 2 is divided into two parts of the outer casing upper half 12 and the outer casing lower half 13 at the dividing horizontal plane. The heights in the vertical direction of the outer casing upper half 12 and outer casing lower half 13 are set equal to each other, so that the center of the height M0 in the vertical direction of the outer casing 10 is positioned on the horizontal line that divides the outer casing 10 into the two parts in FIG. 2. As described above, the position of the center of the height M0 and the position of the shaft center line O may be deviated from each other.

As a comparative example, a case is assumed, where the bottom of the outer casing 10 illustrated in FIG. 2 is fixed to the foundation 70 located below the bottom. In this case, when the counterclockwise force above mentioned is applied to the outer casing 10, a moment of force on the fixing part at the bottom as a fulcrum is applied to generate large bending stress.

Further, for example, when the outer casing 10 and the condenser 190 are connected by the expansion, a large moment of force is applied to the outer casing 10 having the fixing part at the bottom thereof, which may cause the second foot plate 21 to float up from the foundation 70. When the second foot plate 21 floats up from the foundation 70, the center of the stationary blade cascade is deviated from the shaft center line O of the turbine rotor 40, for example. This may cause deterioration in turbine performance and unstable vibration due to rubbing between a rotor and a stationary part.

When the outer casing 10 has the fixing part at the bottom thereof like the above comparison example, it lacks in the structural stability.

On the other hand, in the first embodiment, the key member 120 constituting the fixing part is disposed slightly below the height in the vertical direction at which the cross-sectional center of the outer casing 10 is positioned, as illustrated in FIG. 2. That is, the key member 120 is disposed at a position close to the center axis about which the counterclockwise force above mentioned is applied.

Thus, the moment of force applied on the fixing part having the key member 120 as a fulcrum is smaller than that in the comparative example. As a result, the outer casing 10 having more excellent structural stability can be obtained. Further, in the steam turbine 1, reliability of turbine performance and turbine operation can be ensured.

Second Embodiment

In a steam turbine 2 according to a second embodiment, an outer casing upper half 12A and an outer casing lower half 13A are made to differ in configuration from the outer casing upper half 12 and the outer casing lower half 13 in the first embodiment so as to change the vertical position of the key member 120 with respect to an outer casing 10A. Hereinafter, this different configuration will be mainly described.

Figure 8:
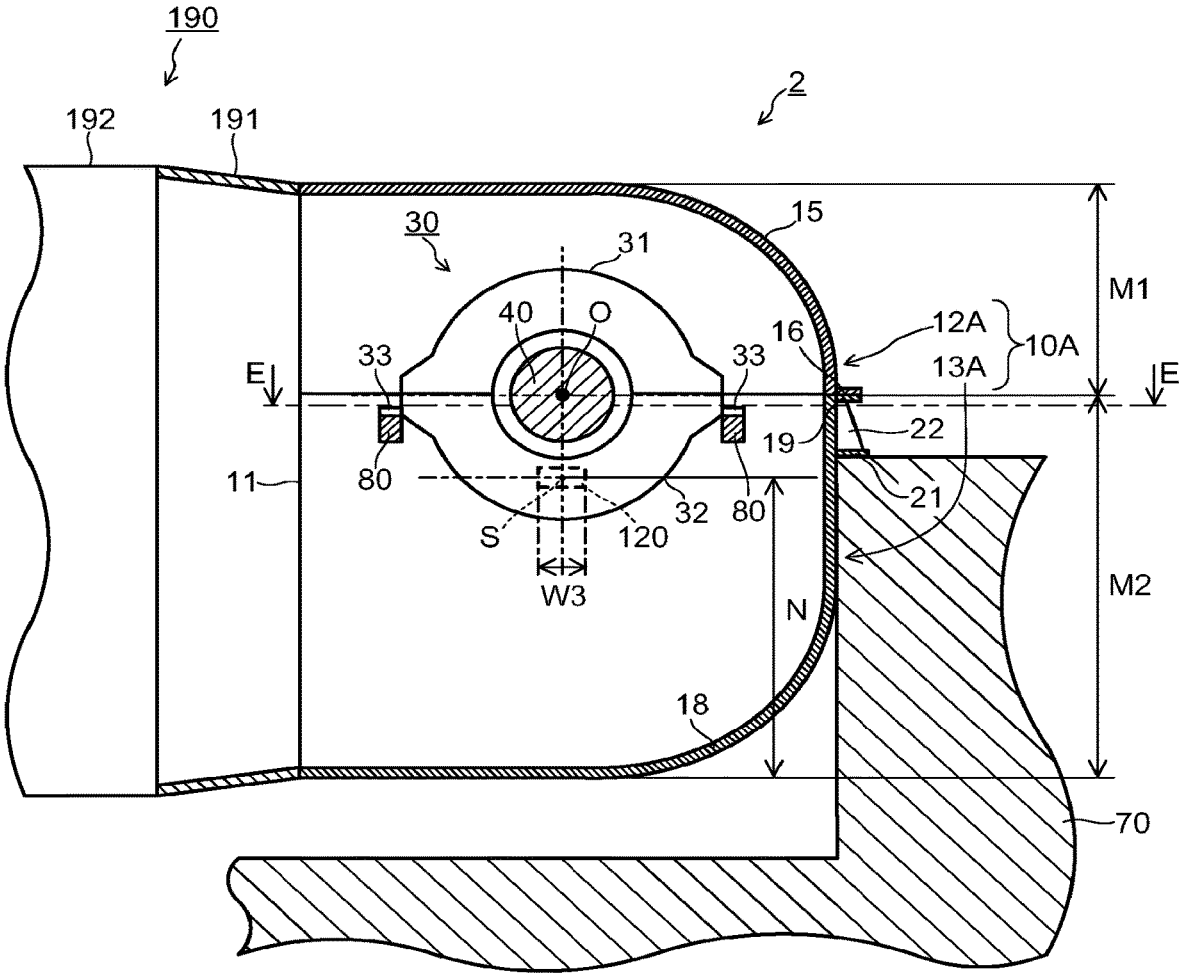
FIG. 8 is a view illustrating the cross section of the steam turbine according to the second embodiment corresponding to the A-A cross section in FIG. 1.
Figure 9:
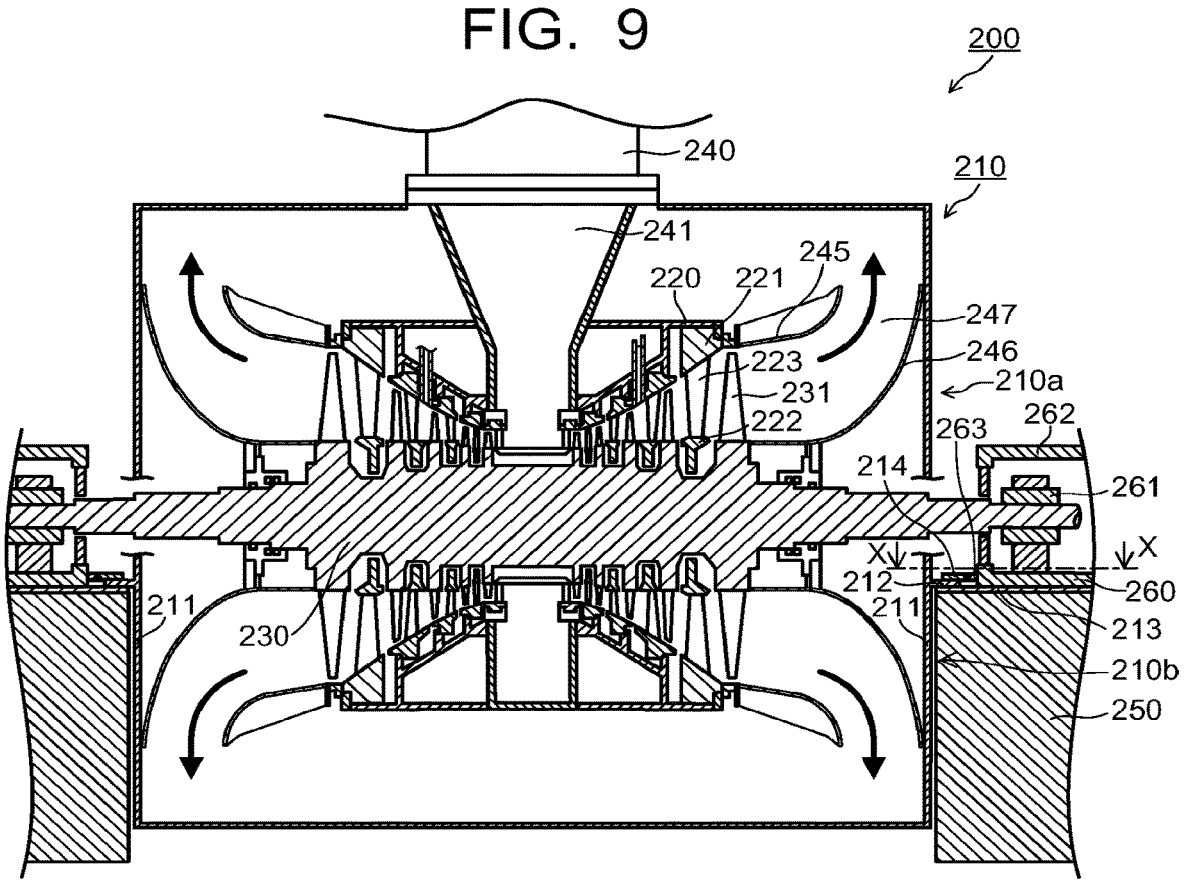
FIG. 9 is a vertical cross-section view of a conventional low-pressure turbine having a downward exhaust structure.
Figure 10:
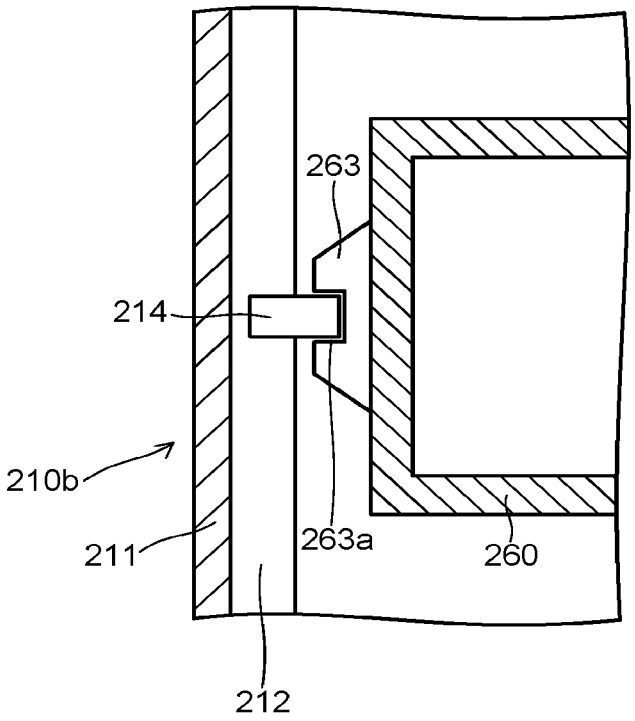
FIG. 10 is a view illustrating an X-X cross section in FIG. 9.

FIG. 8 is a view illustrating the cross section of the steam turbine 2 according to the second embodiment corresponding to the A-A cross section in FIG. 1. In FIG. 8, the configuration of the steam turbine 2 is partially omitted. Further, in FIG. 8, the fixing position between the foundation 70 and the outer casing 10A, i.e., the position of the key member 120 is denoted by a dashed line.

In the second embodiment, the same reference numerals are given to the same components as in the first embodiment and repeated description will be omitted or simplified.

As illustrated in FIG. 8, the outer casing 10A is divided into two parts of the outer casing upper half 12A and outer casing lower half 13A at a horizontal plane including the shaft center line O of the turbine rotor 40.

While, in this example, the dividing horizontal plane between the outer casing upper half 12A and the outer casing lower half 13A is the horizontal plane including the shaft center line O of the turbine rotor 40, the constitution is not limited thereto. For example, the dividing horizontal plane between the outer casing upper half 12A and the outer casing lower half 13A may be positioned above or below the horizontal plane including the shaft center line O of the turbine rotor 40.

The dividing position between the outer casing upper half 12A and the outer casing lower half 13A is positioned vertically above that in the outer casing 10 according to the first embodiment. That is, a height M1 in the vertical direction of the outer casing upper half 12A is smaller than a height M2 in the vertical direction of the outer casing lower half 13A.

The vertical position at which the outer casing 10A is divided into two is set such that, in the cross section illustrated in FIG. 8, a center S of the height in the vertical direction of the key member 120 coincides with the height in the vertical direction at which the cross-sectional center of the outer casing 10A is positioned.

Specifically, in FIG. 8, the vertical position at which the outer casing 10A is divided into two is determined such that the center S of the key member 120 overlaps the cross-sectional center of the outer casing 10A. The position of the center S of the key member 120 in the axial direction of the turbine rotor 40 differs from the position of the cross-sectional center of the outer casing 10A in the axial direction of the turbine rotor 40 in FIG. 8.

In the cross section illustrated in FIG. 8, the center S of the key member 120 refers to a point where the center of the height in the vertical direction of the key member 120 and the center of the width W3 of the key member 120 overlap each other. The cross-sectional center of the outer casing 10A is determined based on the same definition as that for the cross-sectional center of the outer casing 10 in the first embodiment which is described with reference to FIG. 2.

As described above, the outer casing 10A is divided into two at the horizontal plane (dividing horizontal plane between the outer casing upper half 12A and the outer casing lower half 13A) including the shaft center line O of the turbine rotor 40. Accordingly, the position of the turbine rotor 40 with respect to the outer casing 10A is above the position of the turbine rotor 40 in the first embodiment.

When the dividing position of the outer casing 10A is set as described above, a distance N in the vertical direction from the bottom surface (the lower end surface of the lower half side plate 18) of the outer casing 10A to the center S of the key member 120 is (M1+M2)/2.

The E-E cross section in FIG. 8 is the same as the cross section illustrated in FIG. 3. The configuration of the fixing structure part for fixing the outer casing 10A to the foundation 70 is the same as the configuration of the fixing structure part 90 of the first embodiment illustrated in FIGS. 5 to 7.

In the cross section illustrated in FIG. 8, the center of the key member 120 in the second embodiment is positioned at the height position in the vertical direction same as that of the cross-sectional center of the outer casing 10A. Further, as described above, in FIG. 8, the center S of the key member 120 overlaps the cross-sectional center of the outer casing 10A.

Thus, the moment of force applied on the fixing part having the key member 120 as a fulcrum hardly acts on the outer casing 10A. As a result, the outer casing 10A having more excellent structural stability can be obtained. Further, in the steam turbine 2, reliability of turbine performance and turbine operation can be ensured.

Further, as in the steam turbine 1 in the first embodiment, it is possible to rigidly fix the outer casing 10A to the foundation 70 by providing the fixing structure part 90 for the outer casing 10A in the steam turbine 2 in the second embodiment Thus, even when the load acts, in directions perpendicular and horizontal to the axial direction of the turbine rotor 40, on one side of the outer casing 10A at which the condenser 190 is provided, the position of the outer casing 10A with respect to the turbine rotor 40 can be maintained at a proper position.

According to the embodiments described above, even when the load acts on the outer casing, the position of the outer casing with respect to the turbine rotor can be maintained at a proper position.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions.

What is claimed is:

1. A steam turbine having a side exhaust structure where a condenser is installed at one side in directions perpendicular and horizontal to an axial direction of a turbine rotor and supported on a foundation, comprising:

an outer casing penetrated with the turbine rotor and vertically divided into an outer casing upper half and an outer casing lower half;

a first groove part formed, inside the outer casing lower half, in each of a pair of end plates extending perpendicular to the axial direction of the turbine rotor, the first groove part being opened upward, the first groove part being recessed to an inside of the outer casing; and a block-shaped key member fitted to both the first groove part and a second groove part, the second groove part being formed at a part of the foundation facing the first groove part, the second groove part being opened upward.

2. The steam turbine according to claim 1, wherein an upper surface of the key member is positioned below an upper surface of the foundation.

3. The steam turbine according to claim 1, wherein a center of a width of the first groove part in directions perpendicular and horizontal to the axial direction of the turbine rotor is positioned vertically below a shaft center line of the turbine rotor.

4. The steam turbine according to claim 1, further comprising a bearing stand installed on the foundation and having a bearing for rotatably supporting the turbine rotor, wherein a part of the key member that is fitted to the second groove part is positioned vertically below the bearing stand.

5. The steam turbine according to claim 1, wherein a height dimension in the vertical direction of the outer casing upper half and a height dimension in the vertical direction of the outer casing lower half are made to differ from each other such that a center of a height in the vertical direction of the key member coincides with a center of a height in the vertical direction of the outer casing.

6. The steam turbine according to claim 1, wherein a gap is provided between the first groove part and the key member in directions perpendicular and horizontal to the axial direction of the turbine rotor, and a flat plate-like adjusting spacer is disposed in the gap.

* * * * *